US010144622B2

(12) United States Patent
Kinjarapu et al.

(10) Patent No.: US 10,144,622 B2
(45) Date of Patent: Dec. 4, 2018

(54) MODULAR HOIST DRUM FOR POWER SHOVEL

(71) Applicant: Caterpillar Global Mining LLC, South Milwaukee, WI (US)

(72) Inventors: Aruna Kinjarapu, Oak Creek, WI (US); Robin Varghese, Perumbavoor (IN); Sivakumar Subramaniam, Pollachi (IN); Tridib K. Das, Franklin, WI (US); Joseph A. Rapp, Franklin, WI (US); Narendra Thippappa, Bengaluru (IN); Gurbachan S. Bumraw, Franklin, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 0 days.

(21) Appl. No.: 15/173,774

(22) Filed: Jun. 6, 2016

(65) Prior Publication Data

US 2017/0349415 A1 Dec. 7, 2017

(51) Int. Cl.

| | |
|---|---|
| ***B66D 1/30*** | (2006.01) |
| ***E02F 3/30*** | (2006.01) |
| ***E02F 3/36*** | (2006.01) |

(52) U.S. Cl.

CPC ..... *B66D 1/30* (2013.01); *E02F 3/304* (2013.01); *E02F 3/308* (2013.01); *E02F 3/36* (2013.01)

(58) Field of Classification Search

CPC ..... B66F 9/187; B66D 1/34; B66D 1/7405; B66D 2700/0166; B66D 2700/0175; B66D 1/26; B66D 1/30

USPC ..... 242/47.08, 47.11, 322

See application file for complete search history.

(56) References Cited

U.S. PATENT DOCUMENTS

| | | | | | |
|---|---|---|---|---|---|
| 1,249,169 | A * | 12/1917 | Moore | B66D 1/34 | 242/586.1 |
| 1,767,938 | A * | 6/1930 | Monnier | B66D 1/34 | 242/388.5 |
| 3,110,096 | A | 11/1963 | Crowley et al. | | |
| 3,933,260 | A * | 1/1976 | Kronlokken | E02F 3/304 | 414/690 |
| 2003/0085391 | A1* | 5/2003 | Noske | B66D 1/30 | 254/266 |
| 2006/0231540 | A1* | 10/2006 | Stava | B23K 9/092 | 219/137 PS |
| 2015/0097148 | A1* | 4/2015 | Wiley | B66D 1/34 | 254/266 |

FOREIGN PATENT DOCUMENTS

| | | | | |
|---|---|---|---|---|
| DE | 1020050040816 | | 8/2006 | |
| DE | 202011001845 | * | 6/2012 | B66D 1/30 |
| JP | 2002096984 | | 4/2002 | |
| JP | 2006137539 | | 6/2006 | |

* cited by examiner

*Primary Examiner* — Ronald P Jarrett

(74) *Attorney, Agent, or Firm* — Miller, Matthias & Hull

(57) ABSTRACT

A modular hoist drum is disclosed for use with a power shovel. The modular hoist drum may have a first outer body, a second outer body, and an anchor body that are hollow and generally cylindrical. The anchor body is connected between the first outer body and the second outer body. The anchor body may include an internal anchor configured to receive a ferrule.

16 Claims, 5 Drawing Sheets

MODULAR HOIST DRUM FOR POWER SHOVEL

TECHNICAL FIELD

The present disclosure is directed to a hoist drum and, more particularly, to a modular hoist drum for a power shovel.

BACKGROUND

Power shovels are in a category of excavation equipment used to remove large amounts of overburden and ore during a mining operation. One type of power shovel is known as a rope shovel. A rope shovel includes a boom, a dipper handle pivotally connected to a mid-point of the boom, and a shovel bucket (also known as a dipper) pivotally connected to one end of the dipper handle. Cables or wire ropes extend from a hoist drum over a pulley at a distal end of the boom and around a second pulley mechanism attached to the dipper. The ropes are reeled in or spooled out by electric, hydraulic, and/or mechanical motors connected to the hoist drum to selectively raise and lower the dipper.

In most rope shovels, the ropes are connected to the hoist drum by way of anchors mounted to an outer surface of the drum. In particular, a cylindrical collar or ferrule is brazed to an end of each rope, the anchors are welded around their perimeters to the outer surface of the drum, and the ferrule of each rope is placed within a corresponding anchor. The ropes extend through the anchors to wrap tangentially around the drum. An exemplary hoist drum is disclosed in DE Patent 10 2005 004 0816 that issued to Schneider et al. on Aug. 10, 2006.

Although a typical hoist drum may be acceptable in some applications, the weld seams around the anchors can crack and fail in other applications. In addition, the tangential trajectories of the ropes at the anchors can allow the ropes to pivot relative to the drum, and pivoting of the ropes has been shown to cause premature rope pull out from the ferrule. Finally, it may be possible in high-load applications for the drum to crush at the anchor sites and/or for welded seams at ends of the drum to crack. Because the welded seams are internal seams, they can be difficult to inspect or repair on the machine.

The internal modular hoist drum of the present disclosure solves one or more of the problems set forth above.

SUMMARY

In one aspect, the present disclosure is directed to a modular hoist drum. The modular hoist drum may include a first outer body, a second outer body, and an anchor body that are hollow and generally cylindrical. The anchor body is connected between the first outer body and the second outer body. The first outer body, the second outer body, and the anchor body are generally welded together to form the hoist drum. The hoist drum may also include an end casting located at an end of the outer body and having a hub extending outward in an axial direction from a center thereof. The hoist drum may further include an outer annular weld seam connecting the end casting to the outer body.

The inner edges of the first outer body and the second outer body can be beveled to receive a weld seam. In another embodiment, the outer edges of the anchor body can be beveled to receive a weld seam.

In another aspect, the present disclosure is directed to an anchor body for use in a modular hoist drum. This anchor body is hollow and generally cylindrical and is configured to be position in the center of a modular hoist drum. The anchor body has an outer curved surface and an internal anchor. The internal anchor may have a flat bottom that is non-tangential with the outer curved surface. The anchor body may have at least one retainer that extends axially inward from the outer curved surface over the flat bottom surface, with the at least one retainer being radially spaced away from the flat bottom surface to form a space configured to receive a ferrule.

In yet another aspect, the present disclosure is directed to a power shovel. The power shovel may include a machine body, a boom pivotally connected at a base end to the machine body, a dipper handle pivotally connected at a midpoint of the boom, and a dipper pivotally connected to a distal end of the dipper handle. The power shovel may also include a cable extending over a distal end of the boom to connect to the second pulley mechanism attached to the dipper, and an internal anchor hoist drum connected to the machine body and configured to reel in the cable. The internal anchor hoist drum may have a first outer body, a second outer body, and an anchor body that are hollow and generally cylindrical. The anchor body is connected between the first outer body and the second outer body. The anchor body may include an internal anchor. The internal anchor may include a flat bottom surface that is non-tangential with the outer annular surface. The internal anchor hoist drum may further have a plurality of annular grooves formed within the outer annular surface of the drum body. The internal anchor hoist drum may additionally include an end casting connected to an end of the outer body by way of an outer annular weld seam and having a hub extending outward an axial direction from a center thereof, and a flange formed at an end of the drum opposite the end casting and extending radially outward.

DETAILED DESCRIPTION

Figure 1:
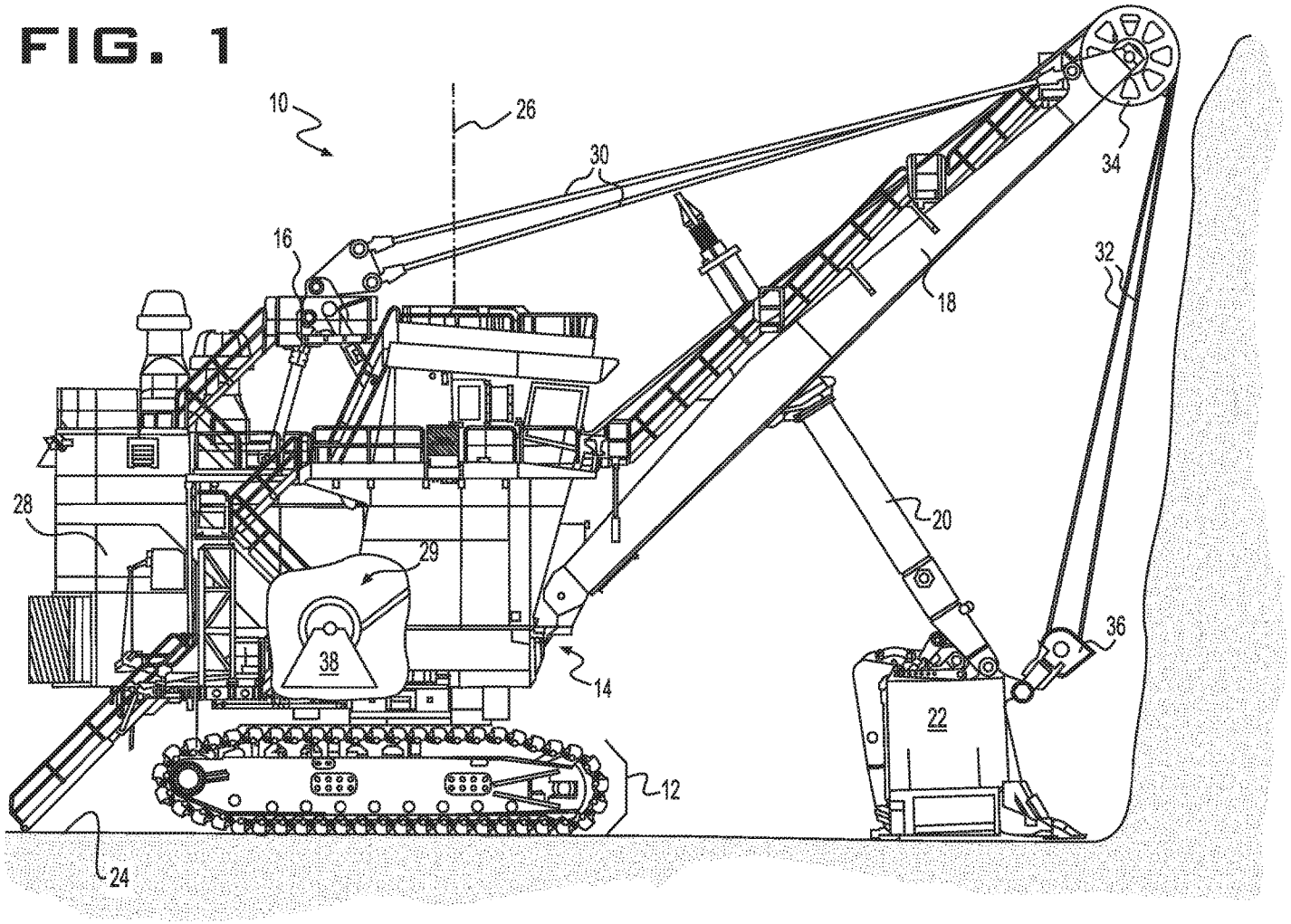
FIG. 1 is a diagrammatic illustration of an exemplary disclosed machine.

FIG. 1 illustrates an exemplary embodiment of a machine 10. Machine 10 may perform some type of operation associated with an industry such as mining, construction, or any other industry known in the art. For example, machine 10 may embody an earth moving machine such as the power shovel (also known as a rope shovel) depicted in FIG. 1. As a power shovel, machine 10 may include a crawler 12, a frame 14 operatively connected to crawler 12, a gantry (also known as an A-frame) 16 rigidly mounted to a top side of frame 14 opposite crawler 12, a boom 18 pivotally connected to a leading end of frame 14, a dipper handle 20 pivotally connected to a midpoint of boom 18, a tool (e.g., a dipper or shovel bucket) 22 pivotally connected to a distal end of dipper handle 20, and cabling connecting gantry 16 to boom 18.

Crawler 12 may be a structural unit that supports movements of machine 10. In the disclosed exemplary application, crawler 12 is itself movable, having one or more traction devices such as feet, tracks, and/or wheels that are driven to propel the machine 10 over a work surface 24. In other applications, however, crawler 12 may be a stationary platform configured for direct engagement with work surface 24.

Frame 14 may pivot relative to crawler 12 about a vertical axis 26. As frame 14 is pivoted about vertical axis 26, attached gantry 16, boom 18, dipper handle 20, and tool 22 may likewise pivot to change a radial engagement angle of tool 22 with work surface 24. In the exemplary embodiment of FIG. 1, tool 22 typically engages with a vertical face of work surface 24, and a horizontal face of work surface 24 may be formed as a result of such engagement. The horizontal face of work surface 24 may be removed by tool 22 in subsequent passes and/or by additional machines located proximate work surface 24. Frame 14 may house, among other things, a power source (e.g., a combustion engine) 28 and an internal anchor hoist drum ("drum") 29 that is driven by power source 28.

Gantry 16 may be a structural frame, for example a general A-shaped frame, which is configured to anchor one or more static cables 30 to frame 14. Gantry 16 may extend from frame 14 in a vertical direction away from crawler 12. Gantry 16 may be located rearward of boom 18 relative to tool 22 and, in the disclosed exemplary embodiment, fixed in a single orientation and position. Cables 30 may extend from an apex of gantry 16 to a distal end of boom 18, thereby transferring a weight of boom 18, tool 22, and a load contained within tool 22 into frame 14.

Boom 18 may be pivotally connected at a base end to frame 14, and constrained at a desired vertical angle relative to work surface 24 by cables 30. Additional cables or wire ropes ("ropes") 32 may extend from hoist drum 29 over a first pulley mechanism 34 located at the distal end of boom 18 and around a second pulley mechanism 36 of tool 22. Ropes 32 may be dynamic, and selectively reeled-in and spooled-out by hoist drum 29 to affect the height and angle of tool 22 relative to work surface 24. For example, when ropes 32 are reeled in, the decreasing effective length of ropes 32 may cause tool 22 to rise and tilt backward away from work surface 24. In contrast, when ropes 32 are spooled out, the increasing effective length of ropes 32 may cause tool 22 to lower and tilt forward toward work surface 24.

Dipper handle 20 may be pivotally connected at one end to a general midpoint of boom 18, and at an opposing end to a corner of tool 22 adjacent the second pulley mechanism 36 (e.g., rearward of second pulley mechanism 36). In this position, dipper handle 20 may function to maintain a desired distance of tool 22 away from boom 18 and ensure that tool 22 moves through a desired arc as ropes 32 are reeled in and spooled out. In the disclosed embodiment, dipper handle 20 may be connected to boom 18 at a location closer to the base end of boom 18, although other configurations are also possible. In some configurations, dipper handle 20 may be provided with a crowd cylinder (not shown) that functions to extend or retract the dipper handle 20. In this manner, the distance between tool 22 and boom 18 (as well as the arcuate trajectory of tool 22) may be adjusted.

Figure 2:
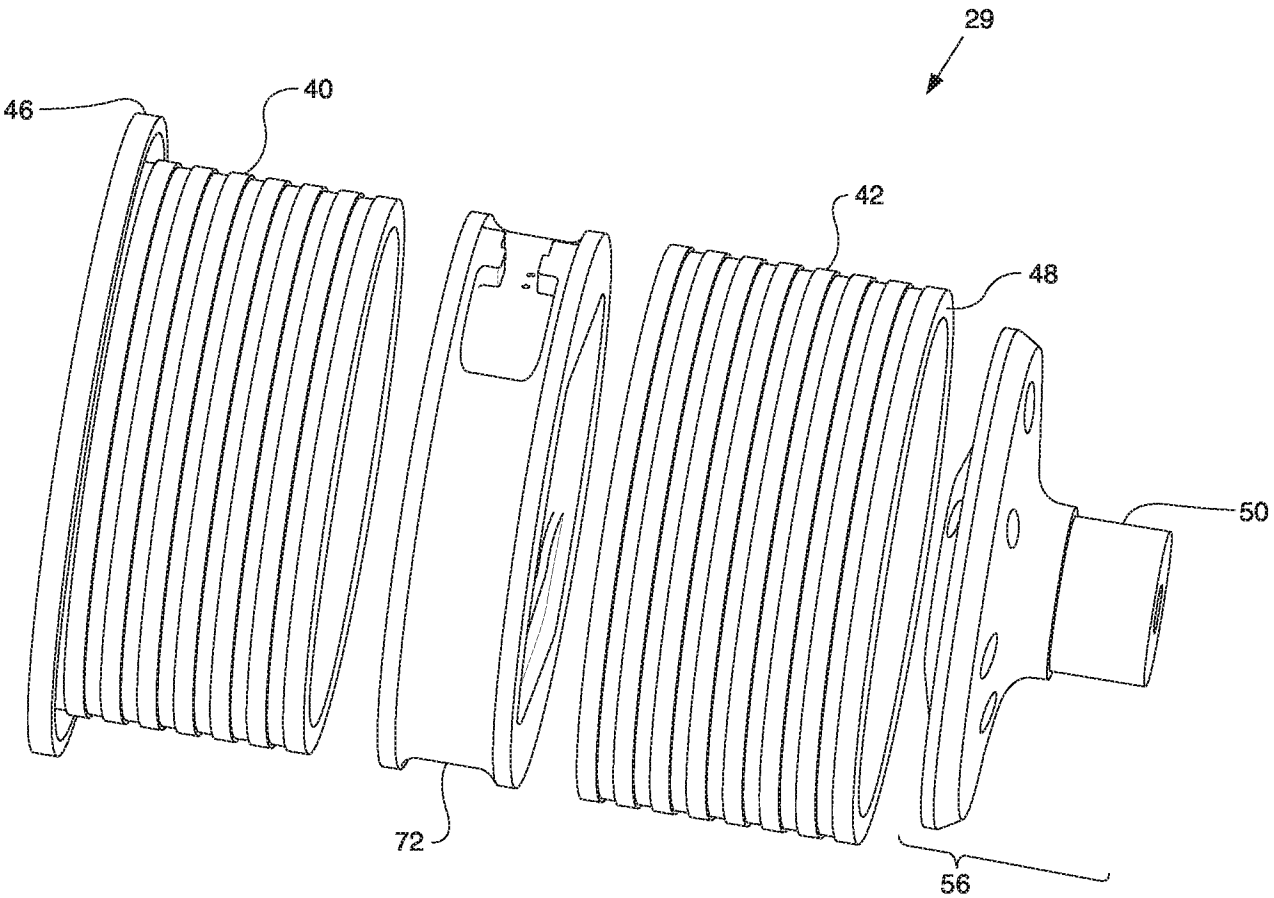
FIG. 2 is a component illustration of the disclosed modular hoist drum that may be used in conjunction with the machine of FIG. 1.
Figure 3:
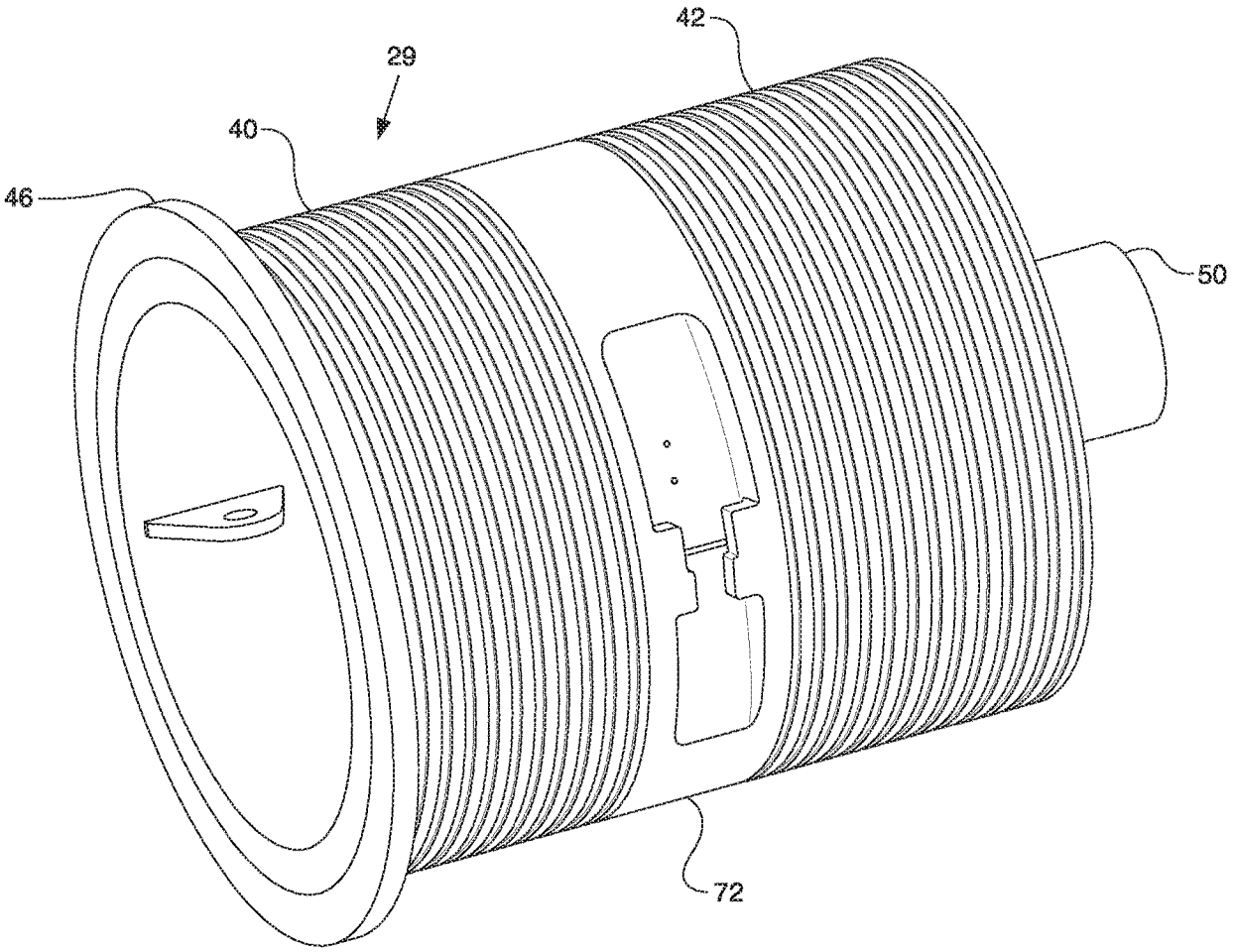
FIG. 3 is an isometric illustrations of the hoist drum of FIG. 2.
Figure 4:
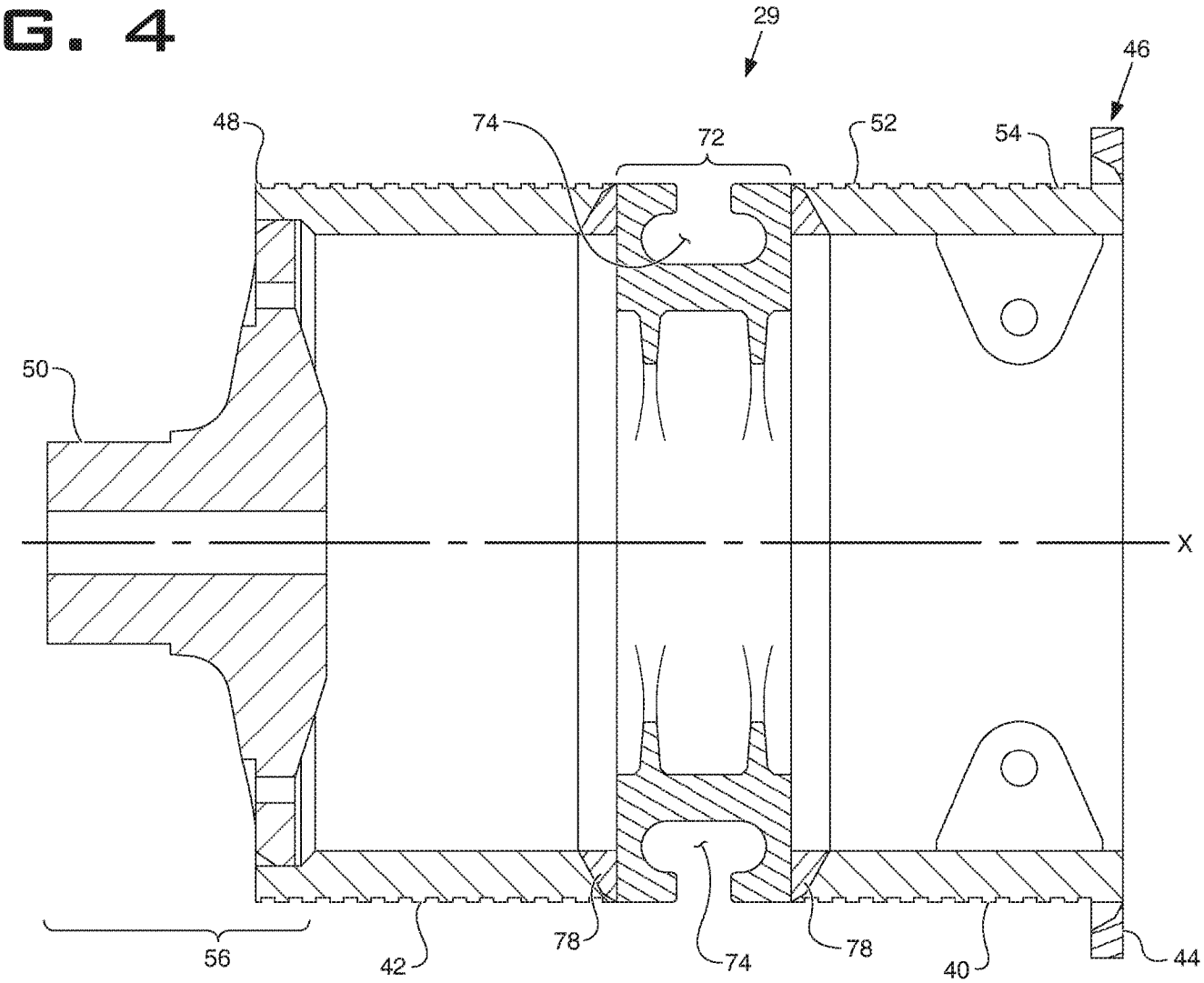
FIG. 4 is a cross-sectional illustration of the modular hoist drum of FIG. 2.

The hoist drum 29 may be rotatably mounted within a pedestal 38 that is fixedly connected to frame 14, and operatively connected to power source 28 via a gear train (not shown). As shown in FIGS. 2-4, the hoist drum 29 may include a first outer body 40 and a second outer body 42 that are generally cylindrical and hollow. In the disclosed embodiment, first outer body 40 and second outer body 42 are forged components, although a cast or rolled component may also be used. A first end 44 of the first outer body 40 may be connected (e.g., bolted) to a component (e.g., to a spider) of the gear train and function as an input end that receives torque sufficient to reel-in and spool-out ropes 32 (referring to FIG. 1). Flange 46 may be welded to or integrally formed with first outer body 40, as desired.

An opposing and second end 48 of the hoist drum 29 may include a hub 50 that rests inside a bearing of pedestal 38. The hoist drum 29 may have a central axis "X" that passes through flange 46, hub 50, and an outer annular surface 52. A plurality of annular cable grooves 54 may be formed within outer annular surface 52. Annular cable grooves 54 may spiral around the hoist drum 29 and be configured to receive and guide ropes 32 (referring to FIG. 1).

Hub 50 may be an integral part of an end casting 56 that is welded to the hoist drum 29. In particular, end casting 56 may have an outer diameter that is about the same (e.g., within manufacturing tolerances) as an outer diameter of annular surface 52 of the hoist drum 29, and end casting 56 may butt up against a second end 48 of the second outer body 42. In one configuration, outer annular surface 52 and an outer edge of end casting 56 may create a substantially continuous surface. Hub 50 may extend axially outward from a center of end casting 56, and one or more holes for lifting (e.g., four equally distributed tapped holes for swivel rings) may be located with an external face of end casting 56 and radially outward of hub 50.

An anchor body 72 can be positioned between the first outer body 40 and the second outer body 42. The anchor body 72 may include internal anchors 74 that can be recessed within outer annular surface 52 of the hoist drum 29 to receive one or more ends of ropes 32. In the disclosed example, two internal anchors 74 are included and each is configured to receive two cable ends (e.g., in opposition to each other). It is contemplated that fewer or more internal anchors 74 may be included, if desired, and each dedicated to holding any number of cable ends. Internal anchor(s) 74 may be generally centered in an axial direction of the hoist drum 29 and, if more than one internal anchor 74 is included, internal anchors 74 may be located symmetrically around the periphery of the hoist drum 29 to improve the balance of the hoist drum 29. For example, when two internal anchors 74 are included, internal anchors 74 may be located opposite each other relative to the hoist drum 29.

Anchor body 72 may be a cast component that is connected between the first outer body 40 and the second outer body 42. The strength of the anchor body 72 enables the exclusion of internal stiffeners across the anchor body 72 inside the hoist drum 29. Weld seams 78 can be located on either side of the anchor body 72 and can connect the anchor body 72 to the first outer body 40 and the second outer body 42. These weld seams 78 may be generally continuous (i.e., within manufacturing tolerances) with arcuate outer surface 76 and outer annular surface 52. The first outer body 40, the second outer body 42, and/or the anchor body 72 may be beveled at weld seams 78 so as to create a channel that receives weld seams 78.

Figure 5:
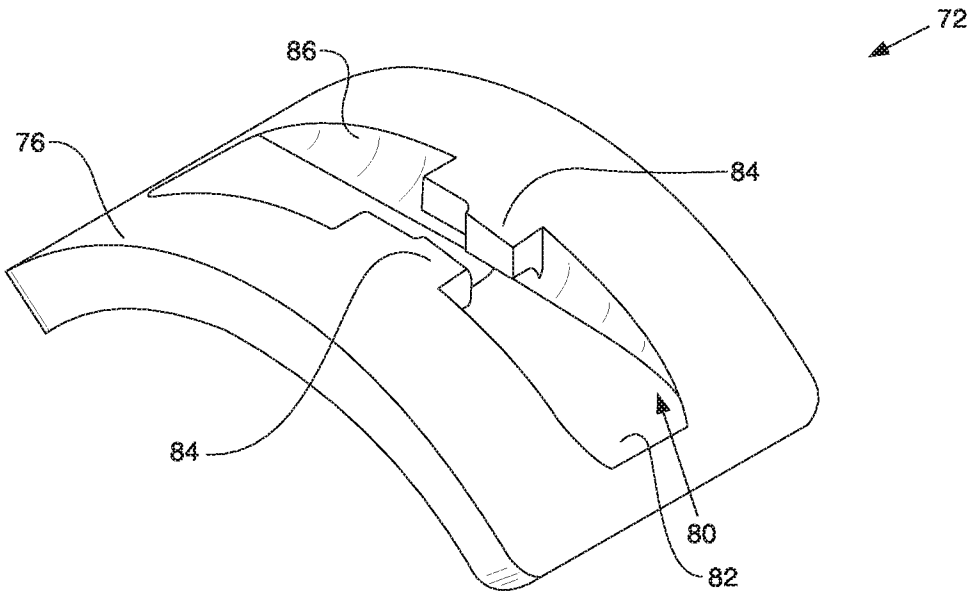
FIG. 5 is an isometric illustration of the internal anchor in the anchor body of FIG. 2.

Referring to FIG. 5, a portion of the anchor body 72 is shown with a focus on the internal anchor 74. The internal anchor 74 may have a longitudinal pocket 80 recessed within arcuate outer surface 76. Pocket 80 may have a flat bottom surface 82 and extend in the length direction about 5-6 times an extension distance in the width direction.

Bottom surface 82 may be oriented generally perpendicular to axis X and non-tangential to outer annular surface 52 of the hoist drum 29. The non-tangential configuration may cause the associated ropes 32 to arch out over an end of bottom surface 82 before lying on outer annular surface 52, the arching functioning to inhibit rotation of ropes 32 relative to the ferrule.

One or more fingers or retainers 84 may extend axially inward from arcuate outer surface 76 a distance over bottom surface 82 to retain the associated cable ends (e.g., to retain ferrules that have been brazed to the rope ends—not shown) inside pocket 80, and retainers 84 may function as end-stops or collars for the ferrules. That is, retainers 84 may be spaced radially away from bottom surface 82 to form a ceiling of pocket 80. In the disclosed embodiment, two retainers 84 are included in each internal anchor 74 and centered relative to the length direction of bottom surface 82. Side walls 86 of pocket 80 may be curved outward (e.g., concave) such that a cross-sectional shape of the internal anchor 74 through pocket 80 may be oval (See FIGS. 2 and 5 and FIG. 4 for a cross-sectional view).

INDUSTRIAL APPLICABILITY

The disclosed hoist drum may be used in any power shovel application where component longevity and reliability are desired. The disclosed hoist drum may have improved longevity due to the strength of the modular hoist drum including a strong anchor body and the connection configuration of end casting 56. In addition, welding a more durable anchor body 72 between the first outer body 40 and the second outer body 42 enables the use of an internal anchor 74 without any internal stiffeners across the interior of the hoist drum 29. Finally, the non-tangential configuration of internal anchors 74 may inhibit rotation and the associated premature rope pull out from the ferrule.

It will be apparent to those skilled in the art that various modifications and variations can be made to the disclosed power shovel and modular hoist drum. Other embodiments will be apparent to those skilled in the art from consideration of the specification and practice of the disclosed power shovel and hoist drum. It is intended that the specification and example be considered as exemplary only, with a true scope being indicated by the following claims and their equivalents.

What is claimed is:

1. A modular hoist drum, comprising:

a first outer body;

a second outer body including an end casting coupled to an outer end of the second outer body, the end casting having an outermost diameter substantially equal to an outer diameter of an annular surface of the modular hoist drum and the end casting being adjacently positioned to the outer end of the second outer body such that an outer edge of the end casting and the annular surface of the modular hoist drum create a substantially continuous surface;

an anchor body disposed between and connected to each of an inner end of the first outer body and an inner end of the second outer body such that the modular hoist drum is hollow and generally cylindrical;

an internal anchor recessed within an outer annular surface of the modular hoist drum the internal anchor includes a flat bottom surface orientated perpendicular to a central axis of the modular hoist drum and non-tangential with the outer annular surface of the modular hoist drum; and at least two retainers formed within the internal anchor that are axially aligned and oppositely positioned across the flat bottom surface from each other, the at least two retainers extend axially inward from an outer curved surface of the anchor body and spaced radially above the flat bottom surface of the internal anchor such that a space is defined within the internal anchor to receive a ferrule.

2. The modular hoist drum of claim 1, wherein the internal anchor further includes the outer curved surface of the anchor body being substantially aligned with the outer annular surface of the modular hoist drum.

3. The modular hoist drum of claim 2, wherein the space of the internal anchor further includes a longitudinal pocket recessed within the outer curved surface of the internal anchor, and wherein the at least two retainers are radially spaced from the flat bottom surface to form a ceiling of the longitudinal pocket.

4. The modular hoist drum of claim 3, wherein the longitudinal pocket includes a pair of concave sidewalls that define an oval cross-sectional shape of the internal anchor within the longitudinal pocket.

5. The modular hoist drum of claim 1, wherein a length of the space within the internal anchor is about 5 times to about 6 times a width of the space within the internal anchor.

6. The modular hoist drum of claim 1, wherein an inner surface of the first outer body and an inner surface of the second outer body are beveled to receive a weld seam.

7. The modular hoist drum of claim 6, wherein an inner annular surface of the first outer body and the second outer body and a curved outer surface of the anchor body are generally continuous.

8. The modular hoist drum of claim 1, further including a plurality of annular grooves formed within an outer axial surface of the first outer body and the second outer body.

9. The modular hoist drum of claim 1, further including:

a flange formed at an end of the first outer body and extending radially outward, and wherein the end casting coupled to the outer end of the second outer body includes a hub extending outward in an axial direction from a center thereof.

10. The modular hoist drum of claim 1, wherein an end casting is connected to the first outer body by way of a weld seam, such that the outer annular surface of the modular hoist drum, an edge of the end casting, and the weld seam are generally continuous.

11. The modular hoist drum of claim 1, wherein the anchor body is axially centered within the modular hoist drum.

12. A power shovel, comprising:

a machine frame;

a boom pivotally connected at a base end to the machine frame;

a dipper handle pivotally connected at a midpoint of the boom;

a dipper pivotally connected to a distal end of the dipper handle;

a rope extending over a distal end of the boom to connect to the distal end of the dipper handle; and a modular hoist drum connected to the machine frame and configured to reel in the rope, the modular hoist drum including:

a first outer body;

a second outer body including an end casting coupled to an outer end of the second outer body, the end casting having an outermost diameter substantially equal to an outer diameter of an annular surface of the modular hoist drum and the end casting being adjacently positioned to the outer end of the second outer body such that an outer edge of the end casting and the annular surface of the modular hoist drum create a substantially continuous surface;

an anchor body disposed between and connected to each of an inner end of the first outer body and an inner end of the second outer body such that the modular hoist drum is hollow and generally cylindrical;

an internal anchor recessed within an outer annular surface of the modular hoist drum, the internal anchor includes a flat bottom surface orientated perpendicular to a central axis of the modular hoist drum and non-tangential with the outer annular surface of the hoist drum; and at least two retainers formed within the internal anchor that are axially aligned and oppositely positioned across the flat bottom surface from each other, the at least two retainers extend axially inward from an outer curved surface of the anchor body and spaced radially above the flat bottom surface of the internal anchor such that a space is defined within the internal anchor to receive a ferrule;

a plurality of annular grooves formed within the outer annular surface of the modular hoist drum;

a hub extending outward in an axial direction from a center of the end casting; and a flange formed at an end of the first outer body and extending radially outward.

13. The power shovel of claim 12, wherein the internal anchor includes the outer curved surface of the anchor body being substantially aligned with the outer annular surface of the modular hoist drum.

14. The power shovel of claim 12, wherein an inner surface of the first outer body and an inner surface of the second outer body are beveled to receive a weld seam.

15. The power shovel of claim 12, wherein the space of the internal anchor further includes a longitudinal pocket recessed within an outer curved surface of the internal anchor, and wherein the at least two retainers are radially spaced from the flat bottom surface to form a ceiling of the longitudinal pocket.

16. The power shovel of claim 15, wherein the longitudinal pocket includes a pair of opposing concave sidewalls that define an oval cross-sectional shape of the internal anchor within the longitudinal pocket.

* * * * *